United States Patent [19]

Suzuki et al.

[11] Patent Number: 4,601,856

[45] Date of Patent: Jul. 22, 1986

[54] METHOD OF PURIFYING OLEIC ACID

[75] Inventors: Masao Suzuki, Nishinomiya; Kenichi Hashimoto, Kobe; Tadashi Satoh, Nishinomiya, all of Japan

[73] Assignee: Nippon Oil and Fats Company, Limited, Tokyo, Japan

[21] Appl. No.: 803,219

[22] Filed: Dec. 2, 1985

[30] Foreign Application Priority Data

Jun. 12, 1984 [JP] Japan ..... 59-119170

[51] Int. Cl.[4] ..... C11C 1/08

[52] U.S. Cl. ..... 260/419

[58] Field of Search ..... 260/419

[56] References Cited

U.S. PATENT DOCUMENTS

| | | | |
|---|---|---|---|
| 2,596,344 | 5/1952 | Newey et al. | 260/419 |
| 2,717,890 | 9/1955 | Drechsel | 260/419 |
| 2,911,423 | 11/1959 | Greenfield | 260/419 |
| 3,052,699 | 9/1962 | Beal | 260/419 |
| 3,720,696 | 3/1973 | Osawa | 260/419 |
| 4,170,601 | 10/1979 | Leadbetter | 260/419 |
| 4,377,526 | 3/1983 | Fujita et al. | 260/419 |

FOREIGN PATENT DOCUMENTS

| | | | |
|---|---|---|---|
| 2611 | 3/1963 | Japan | 260/419 |
| 585152 | 12/1977 | U.S.S.R. | 260/419 |

OTHER PUBLICATIONS

Parker et al., "J. Am. Oil Chemists Soc.", vol. XXXIV, No. 1, Jan. 1957, pp. 43–44, Reprint.

Swern et al., "J. Am. Oil Chemists Soc.", Jan. 1953, pp. 5–7.

*Primary Examiner*—J. E. Evans

*Attorney, Agent, or Firm*—Parkhurst & Oliff

[57] ABSTRACT

A method of producing a highly purified oleic acid is disclosed, which comprises the steps of:

(a) separating and removing the resulting precipitated crystal after the cooling of a solution of oleic acid containing fatty acid mixture and urea in an organic solvent;

(b) separating the resulting crystallized crystal after the partial saponification of the organic solvent solution; and (c) subjecting the crystal to an acid decomposition.

14 Claims, No Drawings

METHOD OF PURIFYING OLEIC ACID

BACKGROUND OF THE INVENTION

1. Field of the Invention

This invention relates to a method of producing a highly purified oleic acid from an oleic acid containing fatty acid mixture.

2. Description of the Prior Art

Oleic acid (cis-9-octadecenoic acid) is a typical unsaturated fatty acid constituting natural fats and oils or biological lipids, which is a very important substance in industry and biology.

It has been confirmed recently that highly purified oleic acid is colorless and odorless, excellent in the stability, high in the safety and has many excellent physical, chemical and physiological properties. Thus, such an oleic acid is actively and widely applied to fine chemical fields such as the life science of pharmaceuticals, cosmetics and foods, bioscience of biosensors and biosurfactants, electronics for simulation of biological function and so on as well as for presently developing high technologies.

However, commercially available oleic acid includes fatty acid homologues having different carbon numbers and double bond numbers, and has a purity as low as 60–90%. In addition, commercially available oleic acid also contains various minor impurities. Therefore, the commercially available oleic acid is unsatisfactory in the qualities such as color, odor, stability, safety and the like and can not adequately develop performances inherent to oleic acid.

As a method of increasing a purity of the fatty acid, there have generally been known various methods such as solvent separation, emulsification separation, urea separation and the like from the past. Recently, chromatographies using an adsorbent, an ion exchange resin and the like have been used. However, these methods are unsuitable in view of separation and refining levels, production capacity, production cost and the like as an industrial means for producing highly purified fatty acids.

Moreover, there is a method wherein the purity of oleic acid is increased by subjecting polyunsaturated fatty acid such as linoleic acid, linolenic acid or the like to a partial hydrogenation. However, this method has a problem of producing positional and geometrical isomers.

As the demand for oleic acid is increased with the diversification of applications, it becomes important to provide an oleic acid having high purity and high quality.

SUMMARY OF THE INVENTION

It is, therefore, an object of the invention to produce a highly purified oleic acid from a wider variety of starting materials by a simple process without producing positional and geometrical isomers.

According to the invention, there is provided a method of producing oleic acid, comprising the steps of:

(a) dissolving an oleic acid containing fatty acid mixture and urea in an organic solvent and cooling them to separate and remove the resulting precipitated crystal therefrom;

(b) partially saponifying the fatty acid mixture contained in the organic solvent solution to separate a crystal by crystallization; and (c) subjecting the resulting crystal to an acid decomposition.

DESCRIPTION OF THE PREFERRED EMBODIMENTS

According to the invention, the step (a) is a step for removing higher saturated fatty acids having a carbon number of not less than 16 and monounsaturated fatty acids higher than oleic acid from the oleic acid containing fatty acid mixture. After step (a), a small amount of urea inevitably remains in the resulting organic solvent solution. When the organic solvent solution is subjected to the step (b), the remaining urea moderately forms an adduct with an acid salt of oleic acid to produce a hard and light powdery crystal, so that the crystallized state of the partially saponified fatty acid mixture is improved to facilitate the filtration of crystal obtained by crystallization, whereby the removal of polyunsaturated fatty acids such as linoleic acid and so on, monounsaturated fatty acids lower than oleic acid, lower saturated fatty acids and other impurities can be performed efficiently. Thus, it is possible to produce a highly purified oleic acid.

As the oleic acid containing fatty acid mixture, use may be made of any mixtures containing oleic acid, an example of which includes fatty acids and mixtures thereby obtained by hydrolysis of fats and oils such as olive oil, sesame oil, rice bran oil, soybean oil, teased oil, camellia oil, corn oil, rapeseed oil, palm oil, peanut oil, safflower oil, sunflower oil, tallow, lard, chicken oil, mutton tallow, fish oil and the like. Furthermore, the commercially available oleic acid containing impurities may be used as the starting material. Since the significance of the starting material is dependent upon the separation effect of impurities according to the invention, the starting material having a higher oleic acid content is generally advantageous, but the selection of the starting material is determined by the objective purity and quality of oleic acid and the kind and amount of impurities in the starting material.

As the organic solvent used in the step (a), use may be made of lower alcohols such as methanol, ethanol, n-propanol, isopropanol and the like and a mixed solvent consisting mainly of such a lower alcohol. The amount of the organic solvent used can not absolutely be determined in accordance with the composition of the starting fatty acids, objective purity and yield, set of crystallization number and the like, but is preferably 0.5–10 times the weight of the starting fatty acids. When the amount of the organic solvent is less than 0.5 times by weight, the separation effect lowers, while when it exceeds 10 times by weight, the concentration of fatty acid lowers and the production efficiency reduces unfavorably.

The amount of urea used is determined by the composition of the starting fatty acids, objective purity and yield, crystallization temperature, amount of solvent and the like. Preferably, the amount of urea used is 3–50 times the total weight of saturated fatty acids having a carbon number of not less than 16 and monounsaturated fatty acids higher than oleic acid, which are contained in the starting fatty acids. When the amount of urea is less than 3 times by weight, the removal of saturated fatty acids and higher monounsaturated fatty acids is insufficient, while when it exceeds 50 times by weight, the yield of oleic acid lowers.

In the step (a), urea and oleic acid containing fatty acid mixture are dissolved in the organic solvent by warming and then gradually cooled down to a temperature of not more than 30° C., preferably within a temperature range of 20° C.~−20° C. Thus, the saturated fatty acids having a carbon number of not less than 16 and the monounsaturated fatty acids higher than oleic acid form crystalline adduct with urea, so that the resulting crystals are removed by the usual manner such as filtration, centrifugal separation or the like.

Generally, it is sufficient to perform step (a) a single time. However, step (a) may be repeated when the removal of the saturated fatty acids having a carbon number of not less than 16 and the monounsaturated fatty acids higher than oleic acid is insufficient.

In step (b), the organic solvent solution of the fatty acid mixture obtained at the step (a) is first subjected to a partial saponification by adding alkaline chemicals such as hydroxides, carbonates and so on of lithium, sodium, potassium, ammonia and the like. In this way, an acid salt of oleic acid is formed by the partial saponification, which moderately forms an adduct with a small amount of urea remaining in the step (a) after the cooling to make a filterable crystal as a whole, so that the separation from components such as polyunsaturated fatty acids and so on is easy. The degree of saponification is within a range of from 20% of the oleic acid contained therein to 60% of the total of the fatty acid mixture, preferably from 30% of the oleic acid to 55% of the total of the fatty acid mixture. When the degree of saponification is less than 20% of the oleic acid, the yield of the resulting oleic acid is low, while when it exceeds 60% of the total of the fatty acid mixture, not only is the separation effect lower, but also the crystallized state and filtrability are poor, thereby decreasing the purity of the resulting oleic acid.

The cooling temperaure for crystallizing the acid salt of oleic acid is 10° C.~−30° C., preferably 5° C.~−20° C. When the cooling temperature is higher than 10° C., the yield of oleic acid lowers, while when it is lower than −30° C., the purity of oleic acid reduces.

The resulting acid salt crystal of oleic acid is separated from the solution containing polyunsaturated fatty acid and so on in the usual manner.

Moreover, the purity can be further increased by repeatedly subjecting the acid salt crystal of oleic acid to recrystallizatioin.

As a solvent used in the repeated recrystallization for the acid salt of oleic acid, mention may be made of polar solvents such as methanol, ethanol, isopropanol, n-butanol, isobutanol, acetone, methyl ethyl ketone, diethyl ether, ethyl acetate, acetonitrile and so on, and a mixed solvent containing such polar solvents. In this case, the amount of the solvent used is preferably 1-10 times the weight of the acid salt of oleic acid.

The step (c) is a step wherein the acid salt of oleic acid is subjected to an acid decomposition by adding an acid to produce free oleic acid.

As the acid used in the acid decomposition, mention may be made of inorganic acids such as sulfuric acid, hydrochloric acid, nitric acid, phosphoric acid, phosphorous acid, hypophosphorous acid, carbonic acid, boric acid and so on; and organic acids such as acetic acid, oxalic acid, malonic acid, succinic acid, malic acid, tartaric acid, citric acid and so on. The amount of the acid used is not less than an equivalent, preferably not less than 1.2 equivalents to the base forming the acid salt of oleic acid.

After the acid decomposition, the acid for the acid decomposition remaining in oleic acid is removed by washing with water. In this washing, the emulsification can be prevented by adding a diluted aqueous solution of a polybasic acid such as oxalic acid, citric acid or the like, whereby the acid decomposition for the slight amount of the remaining acid salt of oleic acid is performed completely.

Thus, a high purity oleic acid is obtained. Moreover, in order to remove minor impurities, the resulting oleic acid may be subjected to an adsorbent treatment or distillation usually used in the refining of fatty acids.

As an adsorbent used in the adsorbent treatment, mention may be made of clay, activated clay, activated carbon, silica gel, alumina gel, silica-alumina gel, ion exchange resin synthetic adsorbent and so on, which may be used alone or in admixture. The amount of the adsorbent used in dependent upon the refining degree of oleic acid and the objective quality, but it is 0.1-5% by weight to oleic acid. In the adsorbent treatment, the temperature is not less than the melting point of oleic acid, preferably 30°-80° C., and the treating time is about 20 minutes to 2 hours.

On the other hand, the distillation is performed under a reduced pressure in an inert gas atmosphere in the usual manner. In this case, it is desirable to perform a low temperature distillation under a higher vacuum.

According to the method of the invention, a highly purified oleic acid having a high level of qualities such as stability to oxidation, heat and acidic and basic chemicals, safety to cutaneous health and so on, which have never been attained in the prior art, can be obtained from a wide variety of starting materials by a simple process.

The thus obtained highly purified oleic acid has the following characteristics:

(i) it is colorless and odorless with a high purity;
(ii) it does not contain minor impurities such as oxidation products and the like resulting in the degradation of oleic acid;
(iii) it is excellent in the stability to heat, oxidation and chemicals;
(iv) it is high in the safety to cutaneous health; and
(v) it has special properties such as sharp polymorphism and the like.

By utilizing the above mentioned characteristics, oleic acid obtained according to the method of the invention can widely be employed in the fine chemical fields such as pharmaceuticals, cosmetics, biochemicals, electronics and so on as well as presently developing high technologies.

The following examples are given in illustration of the invention and are not intended as the limitations thereof. In the examples, "%" means "% by weight" unless otherwise specified.

EXAMPLE 1

After 1,242 g of urea was added and dissolved into 4,000 g of methanol under warming at 50° C., 1,000 g of oleic sufflower oil distilled fatty acid warmed at 50° C. was added and dissolved thereinto. Next, the resulting solution was cooled from 50° C. to 10° C. with stirring over 4 hours, and the resulting precipitated crystal was centrifugally filtered off to obtain 5,212 g of a filtrate (content of fatty acids: 625 g, acid value: 198.5, content of urea: 232 g). This filtrate was added with 576 g of an aqueous solution containing 41.5 g of sodium hydroxide (corresponding to 45% of the equivalent of the contained fatty acid) at 40° C. and cooled to −7° C. with stirring over 6 hours to obtain 427 g of a crystal of acid salt of oleic acid (content of acid salt: 370 g) through filtration. The thus obtained crystal was added with 1,856 g of an aqueous solution containing 93 g of phosphoric acid (corresponding to 1.5 times the equivalent of the acid salt) which was subjected to an acid decomposition with stirring at 90° C. for 2 hours. The thus obtained oleic acid layer was fully washed with an aqueous solution of 0.5% citric acid and dehydrated to obtain 356 g of a highly purified oleic acid (A).

EXAMPLE 2

427 g of the acid salt crystal of oleic acid obtained in the same manner as in Example 1 was dissolved into 1,280 g of methanol containing 10% of water under warming at 40° C. and then cooled to −5° C. with stirring over 5 hours to obtain 357 g of a crystal through filtration. This crystal was added with 1,690 g of an aqueous solution of 5% phosphoric acid, which was subjected to an acid decomposition with stirring at 90° C. for 2 hours. The resulting oleic acid layer was fully washed with an aqueous solution of 0.5% citric acid and dehydrated to obtain 324 g of a highly purified olefic acid (B).

EXAMPLE 3

The acid salt crystal of oleic acid obtained through recrystallization in the same manner as in Example 2 was dissolved into 1,071 g of methanol containing 13% of water under warming at 40° C. and then cooled to −5° C. with stirring over 5 hours to obtain 317 g of a crystal through filtration. This crystal was added with 1,574 g of an aqueous solution of 5% phosphoric acid, which was subjected to an acid decomposition with stirring at 90° C. for 2 hours. The resulting oleic acid layer was fully washed with an aqueous solution of 0.5% citric acid and dehydrated to obtain 302 g of a highly purified oleic acid (C).

EXAMPLE 4

Each of the highly purified oleic acids of Examples 1-3 was added to 0.5% of activated carbon, stirred at 50° C. under nitrogen gas atmosphere for 1 hour and filtered to obtain more highly purified oleic acids (A1), (B1), and (C1).

EXAMPLE 5

Each of the highly purified oleic acids of Examples 1-3 was distilled below 220° C. at 1 mmHg while blowing a nitrogen gas to obtain more highly purified oleic acids (A2), (B2) and (C2).

The compositions and quality characteristics of the highly purified oleic acids obtained in Examples 1-5 according to the invention are shown in the following Table 1 together with those of commercially available oleic acids (a) and (b) as Comparative Examples.

The test item 1 shows the composition of fatty acid mixture measured by a gas chromatography using a capillary column. Oleic acid is represented by $C_{18:1}$ *cis*-ω9.

The test item 2 shows a content (milli equivalent/kg) of carbonyl compounds as typical minor impurities.

TABLE 1

| | Test item | | Oleic safflower oil distilled fatty acids | Fatty acids in filtrate after urea separation | Present invention: Example 1 (A) | Example 2 (B) | Example 3 (C) | Example 4 (A1) | Example 4 (B1) | Example 4 (C1) |
|---|---|---|---|---|---|---|---|---|---|---|
| 1 | Composition of fatty acids (%) | $C_{14:0}$ | 0.1 | 0.2 | | | | | | |
| | | $C_{16:0}$ | 4.8 | 0.2 | | | | | | |
| | | $C_{16:1}$ | 0.1 | 0.2 | | | | | | |
| | | $C_{18:0}$ | 2.3 | | | | | | | |
| | | $C_{18:1}$ cis-ω9 | 77.1 | 78.4 | 99.2 | 99.9 | more than 99.9 | 99.2 | 99.9 | more than 99.9 |
| | | $C_{18:1}$ (isomer) | | | | | | | | |
| | | $C_{18:2}$ | 14.2 | 19.8 | 0.8 | 0.1 | | 0.8 | 0.1 | |
| | | $C_{18:3}$ | 0.9 | 1.2 | | | | | | |
| | | $C_{20:0}$ | 0.5 | | | | | | | |
| | | others | | | | | | | | |
| 2 | Carbonyl value (meq/kg) | | 5.2 | | 0.4 | 0.2 | 0.1 | 0.2 | 0.1 | 0 |
| 3 | Odor intensity | | 7 | | 1-2 | 1 | 0-1 | 0-1 | 0 | 0 |
| 4 | Original color (APHA) | | 80 | | 20 | 15 | 10 | 5 | 5 | 5 |
| 5 | Heat color stability (APHA) | | 180 | | 60 | 40 | 30 | 15 | 10 | 5 |
| 6 | Thermal oxidation color stability (APHA) | | 350 | | 80 | 60 | 50 | 40 | 30 | 25 |
| 7 | Base color stability (APHA) | | 400 | | 90 | 70 | 50 | 60 | 40 | 30 |
| 8 | Acid color stability (APHA) | | 450 | | 120 | 90 | 70 | 80 | 60 | 50 |
| 9 | Oxidation stability (POV) | | 22.5 | | 0.1 | 0 | 0 | 0 | 0 | 0 |
| 10 | Skin irritation | | positive | | almost negative | almost negative | almost negative | negative | negative | negative |

| | Test item | | Present invention Example 5 (A2) | (B2) | (C2) | Comparative example: Commercially available oleic acid (a) | Commercially available oleic acid (b) |
|---|---|---|---|---|---|---|---|
| 1 | Composition of fatty acids (%) | $C_{14:0}$ | | | | 3.1 | 2.6 |
| | | $C_{16:0}$ | | | | 4.3 | 3.6 |
| | | $C_{16:1}$ | | | | 7.8 | 6.4 |
| | | $C_{18:0}$ | | | | 1.4 | 1.1 |
| | | $C_{18:1}$ cis-ω9 | 99.2 | 99.9 | more than 99.9 | 68.0 | 71.1 |
| | | $C_{18:1}$ (isomer) | | | | | |
| | | $C_{18:2}$ | 0.8 | 0.1 | | 5.5 | 0.8 |
| | | $C_{18:3}$ | | | | 0.6 | |
| | | $C_{20:0}$ | | | | 0.1 | |
| | | others | | | | 3.5 | 3.8 |
| 2 | Carbonyl value (meq/kg) | | 0.2 | 0 | 0 | 15.6 | 9.2 |
| 3 | Odor intensity | | 0–1 | 0 | 0 | 10 | 8 |
| 4 | Original color (APHA) | | 5 | 5 | 0 | 220 | 120 |
| 5 | Heat color stability (APHA) | | 10 | 5 | 5 | 400 | 280 |
| 6 | Thermal oxidation color stability (APHA) | | 40 | 25 | 15 | ≧500 | ≧500 |
| 7 | Base color stability (APHA) | | 50 | 30 | 20 | ≧500 | ≧500 |
| 8 | Acid color stability (APHA) | | 60 | 40 | 30 | ≧500 | ≧500 |
| 9 | Oxidation stability (POV) | | 0 | 0 | 0 | 26.8 | 6.2 |
| 10 | Skin irritation | | negative | negative | negative | positive | almost positive |

The test item 3 gives an odor index evaluated by an organoleptic test, wherein odorless is 0 and the odor intensity of the commercially available oleic acid (a) is 10, respectively.

In the test items 4 to 8, the larger the value of color, the larger the coloration degree and the poorer the quality.

The test item 5 shows a heat color stability of oleic acid after heated at 205° C. in a nitrogen stream for 1 hour.

The test item 6 shows a thermal oxidation color stability of oleic acid after heated at 150° C. in air for 3 hours.

The test item 7 shows a color stability of oleic acid against basic chemicals after oleic acid is added with an equimolar amount of diethanolamine and heated at 150° C. for 2 hours while being stirred with nitrogen gas.

The test item 8 shows a color stability of oleic acid against acidic chemicals after oleic acid is added with 0.05% of paratoluenesulfonic acid and heated at 150° C. for 1 hour while being stirred with nitrogen gas.

The test item 9 shows a peroxide value (milli equivalent/kg) after oleic acid is heated at 60° C. for 5 hours while being stirred through aeration (300 ml/min). The larger the value, the poorer the oxidation stability.

The test item 10 shows a result of skin irritation test according to Kawai's method [The journal of Dermatology, vol 2, p 19 (1975)], wherein negative is no irritation, almost negative is weak irritation, almost positive is middle irritation and positive is strong irritation. This indicates the safety to cutaneous health.

EXAMPLE 6

After 1,640 g of urea was added and dissolved into 5,000 g of methanol under warming at 60° C., 1,000 g of teaseed oil fatty acids warmed at 60° C. was added and dissolved thereinto. Next, the resulting solution was cooled from 60° C. to 8° C. with stirring over 4 hours, and the resulting precipitated crystal was filtered off to obtain 6,196 g of a filtrate (content of fatty acid: 512 g, acid value: 192.2, and content of urea: 225 g). This filtrate was added with 703 g of an aqueous solution containing 35.1 g of sodium hydroxide (corresponding to 50% of the equivalent of the contained fatty acid) at 40° C. and then cooled to −10° C. with stirring over 6 hours to obtain 418 g of crystals of the acid salt of oleic acid (content of acid salt: 361 g) through filtration. This crystal was added with 1,535 g of an aqueous solution of 3% hydrochloric acid, which was subjected to an acid decomposition with stirring at 90° C. for 2 hours. The resulting oleic acid layer was fully washed with an aqueous solution of 0.5% malic acid and dehydrated to obtain 347 g of a highly purified oleic acid (D).

EXAMPLE 7

The acid salt crystal of oleic acid obtained in the same manner as in Example 6 was dissolved into 1,254 g of methanol containing 12% of water under warming at 40° C. and then cooled to −5° C. with stirring over 5 hours to obtain 350 g of a crystal through filtration. This crystal was added with 1,230 of an aqueous solution of 3% hydrochloric acid, which was subjected to an acid decomposition with stirring at 90° C. for 2 hours. The resulting oleic acid layer was fully washed with an aqueous solution of 0.5% malic acid and dehydrated to obtain 318 g of a highly purified oleic acid (E).

EXAMPLE 8

Each of the highly purified oleic acids of Examples 6 and 7 was added with 3% of silica gel, stirred at 40° C. under nitrogen gas atmosphere for 1 hour and filtered to obtain each of more highly purified oleic acids (D1) and (E1).

EXAMPLE 9

Each of the highly purified oleic acids of Examples 6 and 7 was distilled in the same manner as in Example 5 to obtain each of more highly purified oleic acids (D2) and (E2).

The compositions and quality characteristics of the highly purified oleic acids obtained in Examples 6–9 according to the present invention are shown in the following Table 2.

TABLE 2

| | Test item | | Teaseed oil fatty acid | Fatty acids in filtrate after urea separation | Present invention: Example 6 (D) | Example 7 (E) | Example 8 (D1) | Example 8 (E1) | Example 9 (D2) | Example 9 (E2) |
|---|---|---|---|---|---|---|---|---|---|---|
| 1 | Composition of fatty acids (%) | $C_{16:0}$ | 8.5 | 0.3 | 0.1 | | 0.1 | | | |
| | | $C_{16:1}$ | 0.1 | 0.2 | | | | | | |
| | | $C_{18:0}$ | 2.6 | | | | | | | |
| | | $C_{18:1}$ cis-ω9 | 81.7 | 86.9 | 98.9 | 99.6 | 99.0 | 99.6 | 99.3 | 99.9 |
| | | $C_{18:2}$ | 6.5 | 11.6 | 1.0 | 0.4 | 0.9 | 0.4 | 0.7 | 0.1 |
| | | $C_{18:3}$ | 0.5 | 0.9 | | | | | | |
| | | $C_{20:0}$ | 0.1 | | | | | | | |
| | | $C_{20:1}$ | 0.1 | | | | | | | |
| 2 | Carbonyl value (meq/kg) | | 10.3 | | 0.9 | 0.4 | 0.7 | 0.3 | 0.2 | 0.1 |
| 3 | Odor intensity | | 8 | | 2 | 1 | 1 | 0–1 | 0 | 0 |
| 4 | Original color (APHA) | | 400 | | 40 | 20 | 15 | 10 | 10 | 5 |
| 5 | Heat color stability (APHA) | | ≧500 | | 100 | 70 | 50 | 30 | 20 | 5 |
| 6 | Thermal oxidation color stability (APHA) | | ≧500 | | 120 | 90 | 90 | 60 | 60 | 30 |
| 7 | Base color stability (APHA) | | ≧500 | | 140 | 100 | 110 | 80 | 70 | 40 |
| 8 | Acid color stability (APHA) | | ≧500 | | 180 | 120 | 140 | 90 | 90 | 60 |
| 9 | Oxidation stability (POV) | | 16.7 | | 0.2 | 0 | 0.1 | 0 | 0 | 0 |

EXAMPLE 10

After 1,060 g of urea was added and dissolved into 3,000 g of methanol under warming at 60° C., 1,000 g of olive oil fatty acids warmed at 60° C. was added and dissolved thereinto. Then, the resulting solution was cooled from 60° C. to 15° C. with stirring over 4 hours, and the resulting precipitated crystal was filtered off. The thus obtained filtrate was added and dissolved into 750 g of urea at 50° C., and then cooled to 10° C. with stirring, and the resulting precipitated crystal was again filtered off to obtain 3,488 g of a filtrate (content of fatty acid: 447 g, acid value: 192.8 g, content of urea: 158 g). This filtrate was added with 372 g of an aqueous solution containing 38.8 g of potassium hydroxide (corresponding to 45% of the equivalent of the contained fatty acid) at 40° C. and then cooled to −10° C. with stirring over 6 hours to obtain 342 g of a crystal of the acid salt of oleic acid (content of acid salt: 289 g) through fitration. This crystal was added with 1,894 g of an aqueous solution of 10% citric acid, which was subjected to an acid decomposition with stirring at 90° C. for 2 hours. The resulting oleic acid layer was fully washed with an aqueous solution of 0.5% tartaric acid and dehydrated to obtain 278 g of a highly purified oleic acid (F).

EXAMPLE 11

The acid salt crystal of oleic acid obtained in the same manner as in Example 10 was dissolved into 1,026 g of acetone containing 8% of water under warming at 50° C. and then cooled to −2° C. with stirring over 5 hours to obtain 276 g of a crystal through filtration. This crystal was added with 1,716 g of an aqueous solution of 10% citric acid, which was subjected to an acid decomposition with stirring at 90° C. for 2 hours. The resulting oleic acid layer was well washed with an aqueous solution of 0.5% tartaric acid and dehydrated to obtain 252 g of a highly purified oleic acid (G).

EXAMPLE 12

Each of the highly purified oleic acids obtained in Examples 10 and 11 was added with 2% of activated clay, stirred at 40° C. under nitrogen gas atmosphere for 30 minutes, and filtered to obtain each of more highly purified oleic acids (F1) and (G1).

EXAMPLE 13

Each of the highly purified oleic acids obtained in Examples 10 and 11 was distilled in the same manner as in Example 5 to obtain each of more highly purified oleic acids (F2) and (G2).

The compositions and quality characteristics of the highly purified oleic acids obtained in Examples 10–13 are shown in the following Table 3.

As apparent from the above results, fatty acids other than oleic acid and minor impurities contained in the starting fatty acid mixture can almost completely be removed according to the invention. Furthermore, the highly purified oleic acid according to the invention has a purity of approximately 100%, so that it is colorless

TABLE 3

| | Test item | | Olive oil fatty acids | Fatty acids in filtrate after two times of urea separation | Present invention: Example 10 (F) | Example 11 (G) | Example 12 (F1) | Example 12 (G1) | Example 13 (F2) | Example 13 (G2) |
|---|---|---|---|---|---|---|---|---|---|---|
| 1 | Composition of fatty acids (%) | $C_{16:0}$ | 10.4 | 0.4 | 0.1 | | 0.1 | | | |
| | | $C_{16:1}$ | 0.7 | 1.4 | | | | | | |
| | | $C_{18:0}$ | 3.1 | | | | | | | |
| | | $C_{18:1}$ cis-ω9 | 77.2 | 81.4 | 98.7 | 99.5 | 98.7 | 99.5 | 99.1 | 99.8 |
| | | $C_{18:2}$ | 7.4 | 14.9 | 1.2 | 0.5 | 1.2 | 0.5 | 0.9 | 0.2 |
| | | $C_{18:3}$ | 0.9 | 1.8 | | | | | | |
| | | $C_{20:0}$ | 0.3 | | | | | | | |
| 2 | Carboxyl value (meq/kg) | | 7.2 | | 0.8 | 0.4 | 0.7 | 0.3 | 0.1 | 0 |
| 3 | Odor intensity | | 6 | | 1-2 | 1 | 1 | 0-1 | 0 | 0 |
| 4 | Original color (APHA) | | 350 | | 40 | 20 | 10 | 5 | 10 | 5 |
| 5 | Heat color stability (APHA) | | ≧500 | | 110 | 80 | 40 | 15 | 20 | 5 |
| 6 | Thermal oxidation color stability (APHA) | | ≧500 | | 120 | 90 | 80 | 60 | 50 | 30 |
| 7 | Base color stability (APHA) | | ≧500 | | 140 | 110 | 110 | 80 | 70 | 50 |
| 8 | Acid color stability (APHA) | | ≧500 | | 170 | 120 | 120 | 90 | 80 | 60 |
| 9 | Oxidation stability (POV) | | 17.2 | | 0.2 | 0 | 0.2 | 0 | 0 | 0 |

and odorless and has excellent heat, oxidation and chemical stability as well as being safe to cutaneous health.

What is claimed is:

1. A method of producing oleic acid, comprising the steps of:

(a) dissolving an oleic acid containing fatty acid mixture and urea in an organic solvent and then cooling them to separate and remove the resulting precipitated crystal therefrom;

(b) partially saponifying the fatty acid mixture contained in the organic solvent solution to separate a crystal by crystallization; and (c) subjecting the resulting crystal to an acid decomposition.

2. The method according to claim 1, wherein said fatty acid mixture in the step (a) is selected from hydrolyzates of fats and oils and commercially available oleic acid.

3. The method according to claim 1, wherein said urea in the step (a) is used in an amount of 3-50 times the total weight of saturated fatty acids having a carbon number of not less than 16 and monounsaturated fatty acids higher than oleic acid, which are contained in said fatty acid mixture.

4. The method according to claim 1, wherein said organic solvent in the step (a) is used in an amount of 0.5-10 times the weight of said fatty acid mixture.

5. The method according to claim 1, wherein said cooling in the step (a) is carried out by cooling down to a temperature of not more than 30° C.

6. The method according to claim 1, wherein said partial saponification in the step (b) is carried out by adding alkaline chemicals.

7. The method according to claim 1, wherein the degree of saponification in the step (b) is within a range of from 20% of the oleic acid to 60% of the total of the fatty acid mixture contained in said organic solvent solution.

8. The method according to claim 6, wherein said alkaline chemicals are selected from hydroxides and carbonates of lithium, sodium, potassium and ammonia.

9. The method according to claim 1, wherein said crystallization of the step (b) is performed repeatedly.

10. The method according to claim 9, wherein said crystallization is carried out in the presence of a polar solvent or a mixed solvent thereof.

11. The method according to claim 1, wherein said step (c) is carried out with an inorganic or organic acid.

12. The method according to claim 11, wherein said inorganic acid is selected from sulfuric acid, hydrochlonic acid, nitric acid, phosphoric acid, phosphorous acid, hypophosphorous acid, carbonic acid and boric acid.

13. The method according to claim 11, wherein said organic acid is selected from acetic acid, oxalic acid, malonic acid, succinic acid, malic acid, tartaric acid and citric acid.

14. The method according to claim 1, wherein after said step (c), the resulting oleic acid is subjected to an adsorbent treatment or a distillation.

* * * * *